US007411602B2

(12) United States Patent
Stenzel et al.

(10) Patent No.: US 7,411,602 B2
(45) Date of Patent: Aug. 12, 2008

(54) SYSTEM, METHOD, AND PROGRAM FOR ALTERNATING SHEETS OF MEDIA

(75) Inventors: James G Stenzel, Rochester, NY (US); Vincent Berardi, Webster, NY (US); Cesar R Marquez, Madison, WI (US); Edward P Imes, Ontario, NY (US); Ronald M Edsall, Fairport, NY (US); Warren Brady, Rochester, NY (US); Liam Cummings, Macedon, NY (US); Norman Vanas, Rochester, NY (US); Christopher Delano, Webster, NY (US); Michael Cook, Waterloo, NY (US)

(73) Assignee: Xerox Corporation, Norwalk, CT (US)

( * ) Notice: Subject to any disclaimer, the term of this patent is extended or adjusted under 35 U.S.C. 154(b) by 485 days.

(21) Appl. No.: 11/214,915

(22) Filed: Aug. 31, 2005

(65) Prior Publication Data

US 2007/0046709 A1 Mar. 1, 2007

(51) Int. Cl.
*B41J 2/435* (2006.01)

(52) U.S. Cl. ..... 347/262; 347/264

(58) Field of Classification Search ..... 347/14, 347/16, 229, 234, 250, 262, 264; 399/45; 271/3.13, 262, 265.04
See application file for complete search history.

(56) References Cited

U.S. PATENT DOCUMENTS 7,175,247 B2 * 2/2007 Takenaka et al. ..... 347/14
2005/0169650 A1 * 8/2005 Ito et al. ..... 399/45

* cited by examiner

*Primary Examiner*—Hai C Pham
(74) *Attorney, Agent, or Firm*—Oliff & Berridge, PLC

(57) ABSTRACT

Systems, methods, and programs for adjusting marking data for use with alternately stacked multi-thickness media. The systems, methods, and programs input marking data and determine an orientation of sheets of the multi-thickness media that is alternated within a stack. The systems, methods, and programs adjust, for each sheet whose orientation is not consistent with the marking data, the marking data for that sheet such that the marking data for that sheet is consistent with the orientation of that sheet.

18 Claims, 10 Drawing Sheets

SYSTEM, METHOD, AND PROGRAM FOR ALTERNATING SHEETS OF MEDIA

BACKGROUND

1. Related Technical Fields

Related technical fields include systems, methods, and programs for alternating sheets of media.

2. Background Art

Many conventional marking devices are configured to obtain optimized results with standard sizes of sheets of media such as, for example, letter sized media (8.5" by 11"), A4 media, executive sized media, A5 media, legal sized media, envelopes, and the like. Specifically, for example, the media storage, media transport, and marking functions of these conventional marking devices are designed around these common media sizes such that these sizes of media can be most efficiently used within the devices. Accordingly, special steps and/or user-assisted functions may be required for uniquely sized media.

Such marking devices typically include one or more input modules, each of which may include one or more feeders, into which blank media is loaded for imaging. Conventional feeders are usually adjustable for media size, and generally feed from the top of the stack of media. The feeder generally includes an elevator on which the stack of media is loaded, and which rises as media is fed off the top of the stack reducing the stack height. Thereby, the stack is kept level with the feeding mechanism.

The primary function of the feeder is to advance media to the imaging process one sheet at a time, at very precise intervals, as dictated by the marking device process.

Conventional marking devices typically include one or more output modules, performing various post imaging operations. Typically, the last output module in the imaging and finishing process is a stacker, where consecutive pages or sets of pages are automatically stacked one on top of the previous, as part of the real-time imaging and finishing process.

Some types of combined media for use in these conventional marking devices incorporate a smaller, uniquely sized, sheet of media fixed to at least a portion of a larger, standard sized, sheet of media. These types of media enable marking on the smaller, uniquely sized, sheet of media while utilizing the efficiently stored and transported, standard sized, sheet of media as a vehicle through the marking device. As a result, fewer special steps and/or user-assisted functions are required for marking on the smaller, uniquely sized, sheet of media.

Conventional marking devices that are optimized for standard sized media are designed to begin marking on a leading portion of the sheet of media as it is transported through the device. As a result, the smaller, uniquely sized, sheet of media is frequently fixed to the leading edge of the larger, standard sized, sheet of media. This allows for marking to begin on the leading portion of the combined media.

SUMMARY

The above-described, conventional combined media, as result of having a smaller sheet of media fixed to a leading portion (in the vicinity of the leading edge of the combined media) of the larger sheet of media has a thicker leading portion than trailing portion (in the vicinity of the trailing edge of the combined media). Thus, the leading portion has a thickness equivalent to the thickness of both the small sheet and the large sheet while the trailing portion has a thickness equal to only the large sheet.

As used herein the term "leading edge" is intended to describe the edge of a sheet of media that leads the sheet of media as it is transported through a marking device. Similarly, the term "trailing edge" is intended to describe the edge of a sheet of media that is opposite the leading edge and trails the sheet of media as it is transported through the marking device. As used herein, the terms "feeder" or "media feed mechanism" are intended to describe devices that feed unmarked media into a marking device. The terms "stacker" or "media stacking mechanism" are intended to describe devices that stack marked media after being marked by the marking device. It should be appreciated that the feeder and/or stacker may be included in the marking device or may be separate devices attached to the marking device.

One example of the above-described combined, multi-thickness, media is Xerox Corporation's DocuCard® media. For ease of explanation, the following exemplary systems, method and, programs will be disclosed using DocuCard® type media as an example of combined, multi-thickness, media; however, it should be appreciated that the principles disclosed herein may be applied to any type of media with each sheet having at least two different thicknesses.

Conventional media feeding mechanisms are designed such that feeding reliability is generally maximized when the top of the media stack is level front to back and side to side.

Conventionally, however, the above-described combined, multi-thickness, media is packaged and loaded into the feeder of marking devices with each sheet having the same orientation. Because each sheet has a same orientation, the marking device may process each sheet in the same manner, thus simplifying the marking process. Due to the orientation of the sheets, the thicker portion of each sheet of the combined media is oriented above the thicker portion of the sheets below it and the thinner portion of each sheet of the combined media is oriented above the thinner portion of the sheets below it.

As a result, and as described in further detail below, when the combined multi-thickness media is stacked and loaded into a marking device, there exists a substantial difference in thickness between a leading edge portion of a stack corresponding to the thick portion of the media and a trailing edge of the stack corresponding to the thin portion of the media.

This difference in thickness in the stack of media may cause problems when feeding and transporting the media through the marking device. Because of an increasing angle of incidence of the lead edge of the sheets to the feed mechanism, tall stacks of the combined multi-thickness media may not feet at all (misfeed), or may feed two or more sheets of media simultaneously resulting in a jam.

Currently, in order to avoid jams or misfeeds in conventional general purpose marking devices, users must limit the number of sheets of multi-thickness media that are loaded into a media tray in order to reduce the overall thickness difference between a leading edge portion of the stack and the trailing edge portion of the stack.

Similarly, the performance of conventional media stackers is substantially degraded when the marked media being stacked is not uniformly flat. As media is stacked sheet by sheet in the stacker of the marking device, the top of the stack becomes increasingly unlevel until the slope is great enough that the down-slope gravitational pull on the sheet exceeds the friction between sheets, and the sheets start to slip off of the stack.

Currently, the stacker must be unloaded more frequently, at lower than maximum possible stack height in order to avoid sheets from falling off the stack.

Some marking systems, such as those utilizing Xerox Corporation's Tiltatron® feeding device, have attempted to reduce the frequency of jams caused by combined, multi-thickness, media by incorporating specialized media feed mechanisms designed specifically for multi-thickness media. However, these specialized media feed mechanisms are available for only specific marking devices and require substantial expense and hardware modification for installation.

In view of at least the forgoing, it is beneficial to provide systems, methods, and programs that allow for a large number of sheets of combined multi-thickness media to be loaded in the feeder of a general purpose marking device and stacked in the stacker of a general purpose marking device, without substantial expense and hardware modification.

Accordingly, various exemplary implementations of the principles described herein provide a method of adjusting marking data for use with alternately stacked multi-thickness media. The method may include inputting marking data. The method may include determining an orientation of each sheet of multi-thickness media that is alternated within a stack. The method may include adjusting, for each sheet of multi-thickness media whose orientation is not consistent with the marking data, the marking data for that sheet of multi-thickness media such that the marking data for that sheet of multi-thickness media is consistent with the orientation of that sheet of multi-thickness media.

Various exemplary implementations of the principles described herein provide a storage medium storing a set of program instructions executable on a data processing device and usable to adjust marking data for use with alternately stacked multi-thickness media. The instructions may include instructions for inputting marking data. The instructions may include instructions for determining an orientation of each sheet of multi-thickness media that is alternated within a stack. The instructions may include instructions for adjusting, for each sheet of multi-thickness media whose orientation is not consistent with the marking data, the marking data for that sheet of multi-thickness media such that the marking data for that sheet of multi-thickness media is consistent with the orientation of that sheet of multi-thickness media.

Various exemplary implementations of the principles described herein provide a system for adjusting marking data for use with alternately stacked multi-thickness media. The system may include a controller that may input marking data. The controller may determine an orientation of each sheet multi-thickness media that is alternated within a stack. The controller may adjust, for each sheet of multi-thickness media whose determined orientation is not consistent with the marking data, the marking data for that sheet of multi-thickness media such that the marking data for that sheet of multi-thickness media is consistent with the determined orientation of that sheet of multi-thickness media

BRIEF DESCRIPTION OF THE DRAWINGS

Exemplary implementations will now be described with reference to the accompanying drawings, wherein.

DETAILED DESCRIPTION OF EXEMPLARY IMPLEMENTATIONS

Figure 1:
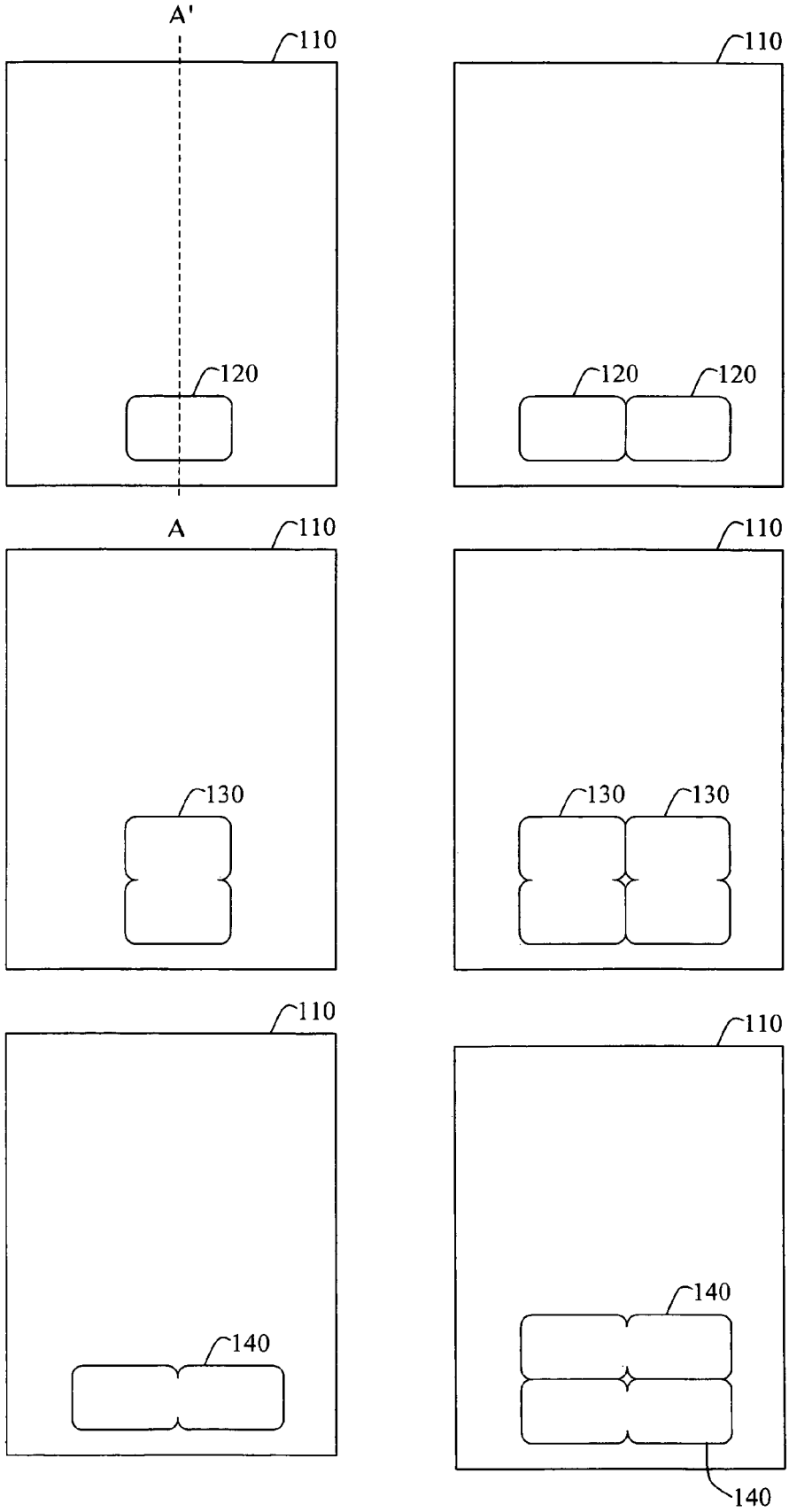
FIG. 1 shows exemplary configurations of multi-thickness media in plan view.

FIG. 1 shows some exemplary configurations of the above-described combined, multi-thickness media. The media may include a standard-sized large sheet of media 110 (hereinafter the "large media") and at least one of a small media 120 for single-side printing, a small media 130 which may be folded along a long axis to approximate double-side printing, and/or a small media 140 which may be folded along a short axis to approximate double-side printing.

Figure 2:
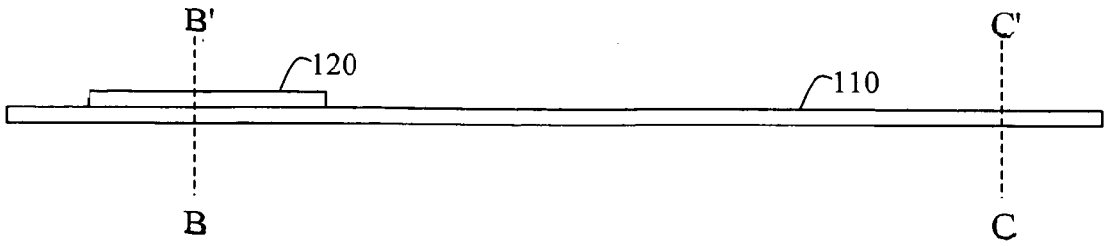
FIG. 2 shows an exemplary configuration of multi-thickness media in cross-section.

FIG. 2 shows an exemplary configuration of multi-thickness media in cross-section. Specifically, FIG. 2 shows a cross-section through line A-A' in FIG. 1, of a combined multi-thickness media including a large sheet of media 110 and a small media 120 for single-side printing. As shown in FIG. 2, the combined multi-thickness media is thicker, in a direction of line B-B', in a portion corresponding to the small media 120. The combined multi-thickness media is thinner, in a direction C-C', in a portion corresponding to only the large media 110.

Figure 3:
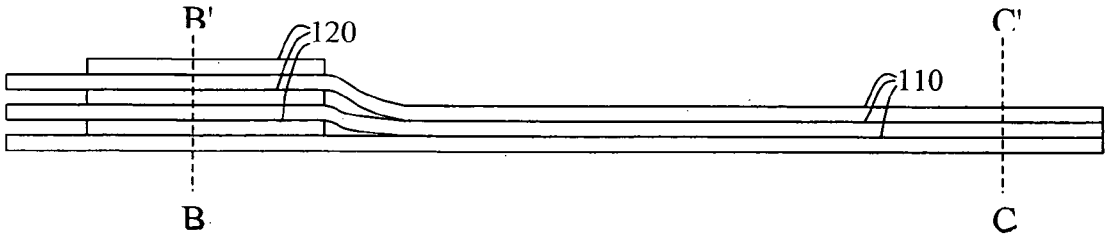
FIG. 3 shows a conventional stacking arrangement of multi-thickness media in cross-section.
Figure 4:
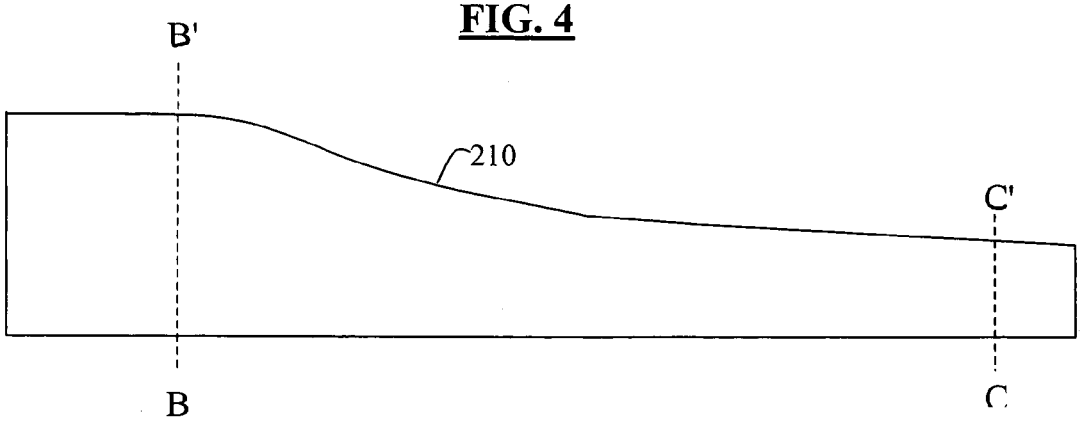
FIG. 4 shows a cross-sectional profile of a conventional stack of a large number of sheets of multi-thickness media.

FIG. 3 shows a plurality of the combined multi-thickness media stacked in a conventional manner. As discussed above, combined multi-thickness media are conventionally stacked in a same orientation in order to simplify the marking process. Thus, as shown in FIG. 3, each sheet is aligned in a stack with a portion corresponding to the small media 120 stacked above a portion corresponding to the small media 120 of the sheet below it. The thicker portion of each sheet is stacked on a thicker portion of each sheet below it. Thus, a portion of the entire stack corresponding to the small media 120 (e.g., in the vicinity of line B-B') is substantially thicker than a portion corresponding to only the large media 110 (e.g., in the vicinity of line C-C'). An example of the resultant shape of a large stack of combined multi-thickness media is shown in FIG. 4.

The difference in thickness between a portion of the stack corresponding to the small media 120 and a portion corresponding only to the large media 110 can cause a number of problems when attempting to load a plurality of sheets into a marking device. For example, by virtue of the slope created by the difference in thickness, sheets on the top of the stack have a tendency to slide off the top of the stack. Additionally, by virtue of the slope created by the difference in thickness, sheets on the thicker end of the stack have a tendency to separate, or fan out, as a result of the slope and the stiffness of the media.

The slope and separation of the sheets when stacked in this conventional manner makes it difficult for a conventional media transport system to effectively contact and transport a single sheet of the combined multi-thickness media through the marking device.

Figure 5:
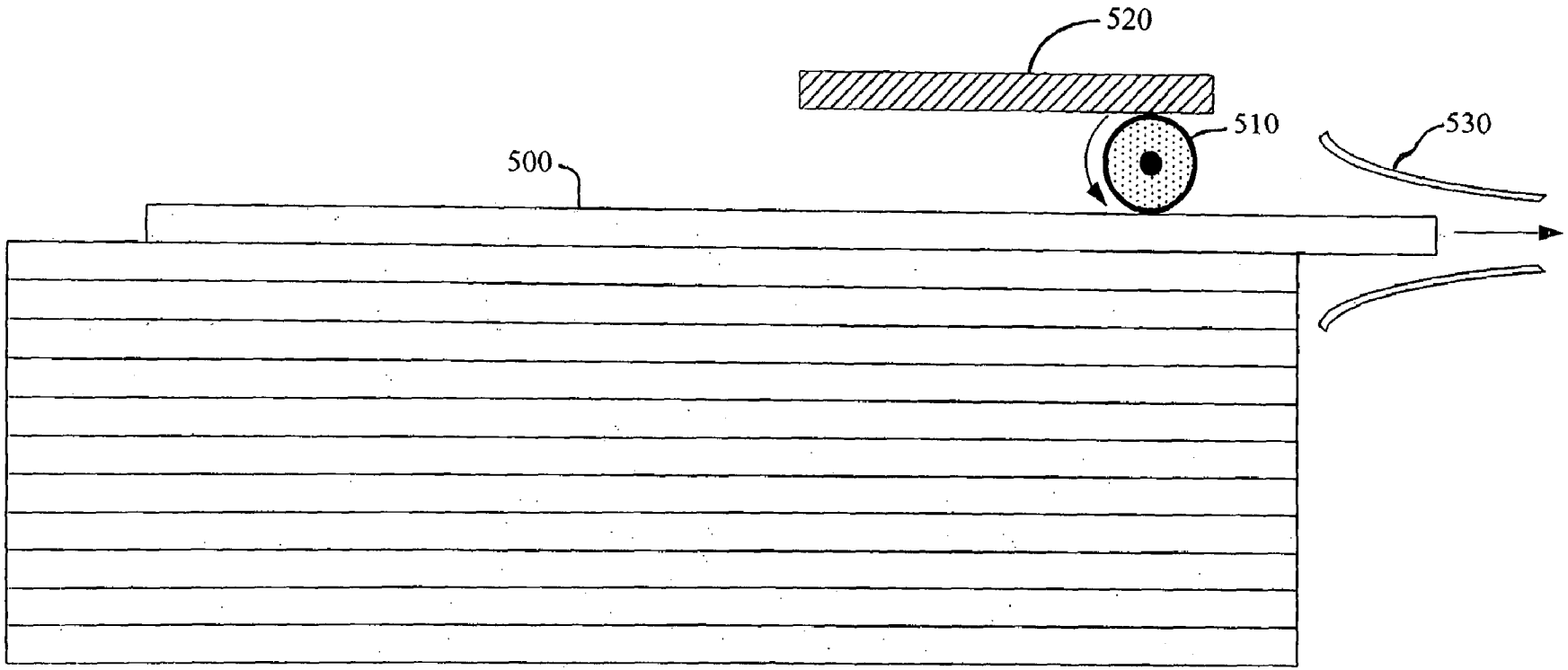
FIG. 5 shows a cross-sectional profile of a conventional stack of sheets of constant thickness media in a feed mechanism.

For example, as shown in FIG. 5, when sheets of constant thickness media 500, are loaded in a feeder, the stack has a substantially constant thickness as well. Thus, when the sheet picker 510 of the feed head 520 pulls a sheet from the stack, a direction of transport of that sheet is properly aligned with the feed chute 530.

Figure 6:
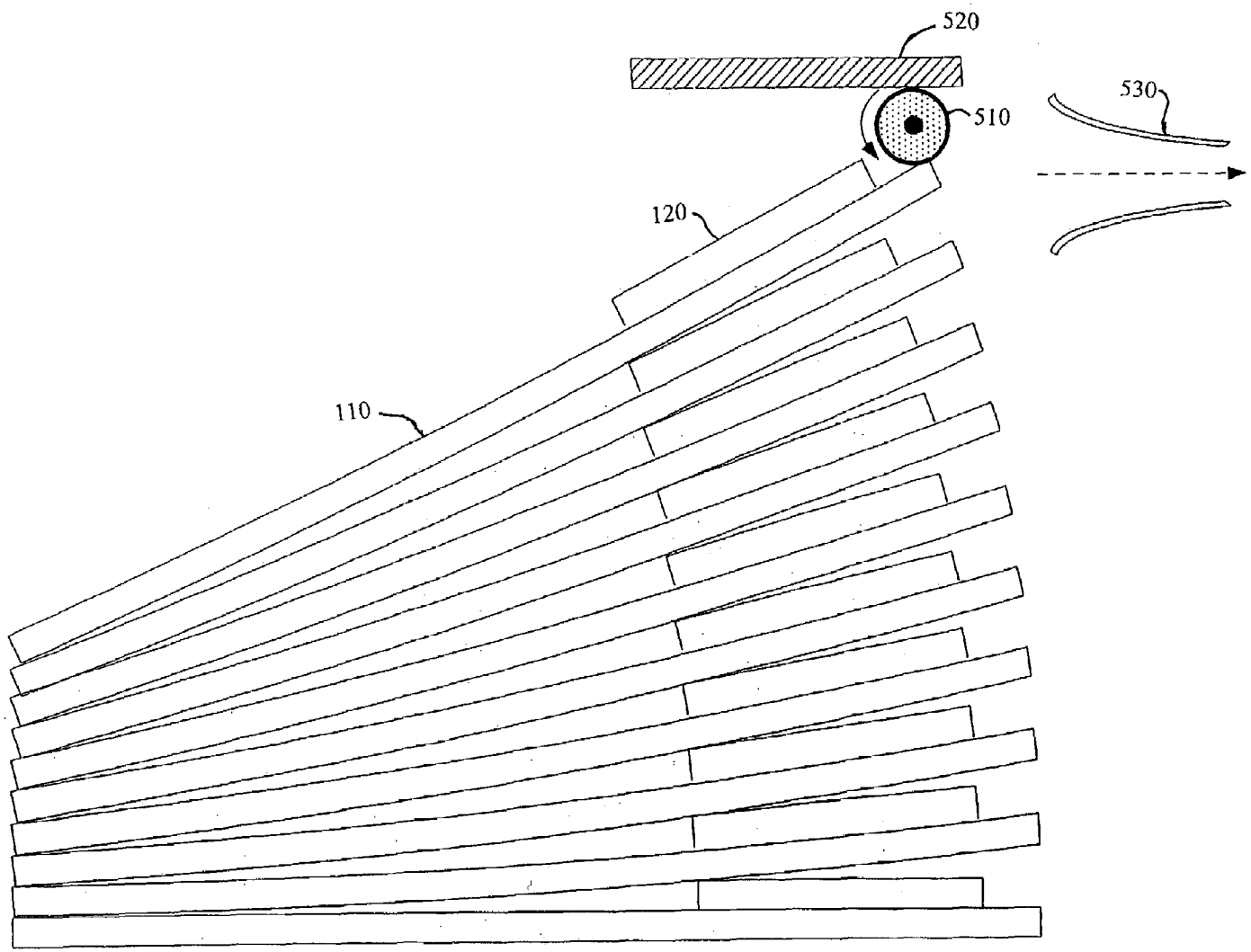
FIG. 6 shows a cross-sectional profile of a conventional stack of sheets of multi-thickness media in a feed mechanism.

However, as shown in FIG. 6, when sheets of multi thickness media, including, for example, large media portion 110 and small media portion 120, are loaded in a feeder stack in a conventional manner, the difference in thickness between a portion of the stack corresponding to the small media 120 and a portion of the stack corresponding to only the large media 110 causes the stack to slope away from the sheet picker 510 and feed head 520. As a result, the leading edges of the sheets are picked by the sheet picker 510 at an angle of incidence substantially corresponding to the slope of the stack. As the height of the stack increases, the angle of incidence increases and thus the greater the separation or fanning of the sheets at their leading edge.

Accordingly, tall stacks, whose sheets are picked at a large angle, may not feet at all (misfeed) if the angle of incidence of the top sheet causes the direction of transport of the sheet to miss or otherwise jam in the feed chute 530. Additionally, when the sheet picker 510 applies a rotational force to the top sheet and the top sheet is at an angle rather than horizontal, the friction between sheets may cause multiple sheets to be picked simultaneously, resulting in a jam.

In order to reduce the likelihood that a jam or misfeed may result due to the stacking of the combined multi-thickness media, many users of marking devices have reduced the number of combined multi-thickness media that are stacked in the marking device at any one time. This requires a user to more closely monitor the number of combined multi-thickness media in the device and more frequently replenish the combined multi-thickness media or to unload the stacker.

Figure 7:
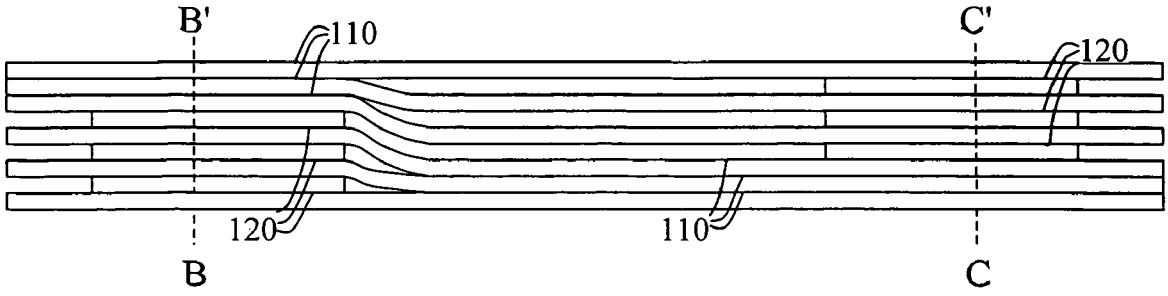
FIG. 7 shows stacked sheets of multi-thickness media in cross-section according to an exemplary implementation of the principles described herein.

Accordingly, it is beneficial to provide systems, methods, and programs that allow for a large number of sheets of combined multi-thickness media to be stacked in the feeder of a general purpose marking device, and for these sheets to be reliably stacked in the stacker after being marked. FIG. 7 shows an example of a method of stacking combined multi-thickness media that substantially reduces the unevenness of the stack. As shown in FIG. 7, a first amount of combined multi-thickness media may be stacked in a same orientation with the thicker portion of each sheet stacked on a thicker portion of each sheet below it. Then, a second amount, for example, having a substantially similar number of sheets as the first portion, may be stacked on the first amount in an orientation such that a thicker portion of the second amount of combined multi-thickness media may be stacked on the thinner portion of the first amount. Additional amounts of combined multi-thickness media may be stacked in the same alternating fashion.

As a result of the configuration shown in FIG. 7, some of the sheets combined multi-thickness media will have the small media 120 in the vicinity of the leading edge of the large media 110 and some of the sheets of combined multi-thickness media will have the small media in a vicinity of the trailing edge of the sheet of media. When taken together, as shown in FIG. 8, a stack including a large number of sheets may have a substantially similar thickness in the vicinity of the small media 120 since the small media is located in both the leading edge and trailing edge portions of the stack.

Figure 9:
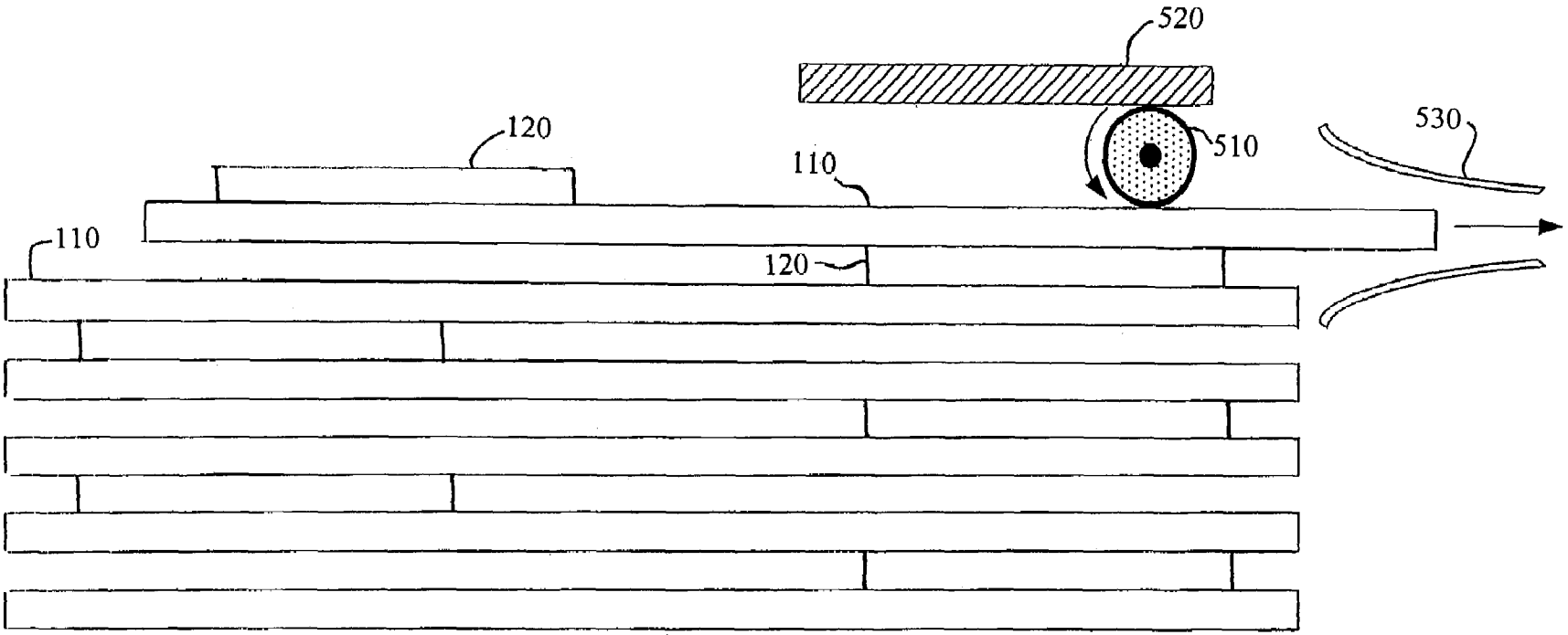
FIG. 9 shows a cross-sectional profile of a stack of sheets of multi-thickness media in a feed mechanism, stacked according to an exemplary implementation of the principles described herein.

By stacking the sheets of combined multi-thickness media in such a manner, the angle of incidence of sheets when picked by the picker 510 is substantially horizontal. As shown in FIG. 9, when sheets of combined multi-thickness media are picked from an alternated stack, the sheet picker 510 of the feed head 520 pulls a sheet from the stack in a direction of transport that is properly aligned with the feed chute 530. Thereby reducing the likelihood of a misfeed and/or jam.

As discussed above, combined multi-thickness media is conventionally stacked in a same orientation (e.g., as shown in FIGS. 3 and 4) in order to simplify the marking process. When conventionally stacked combined multi-thickness media is transported through the marking device, the small media 120 is always in the same location relative to the marking device. As a result, the image device does not need to adjust the position of the marked image with respect to the sheet of combined multi-thickness media.

Figure 8:
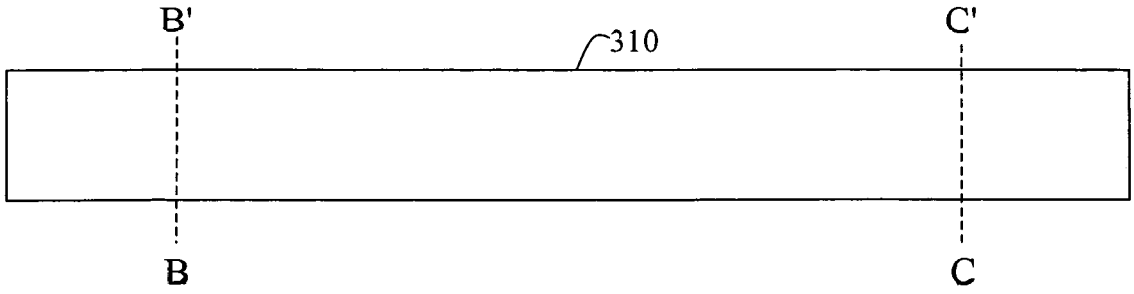
FIG. 8 shows a cross-sectional profile of a stack of a large number of sheets of multi-thickness media according to an exemplary implementation of the principles described herein.

According to the stacking method shown in FIGS. 7-9, the location of the small media 120 relative to the stack is not the same. Similarly, the location of the small media 120 within the marking device will vary depending upon the orientation of the sheet to be marked.

Figure 10:
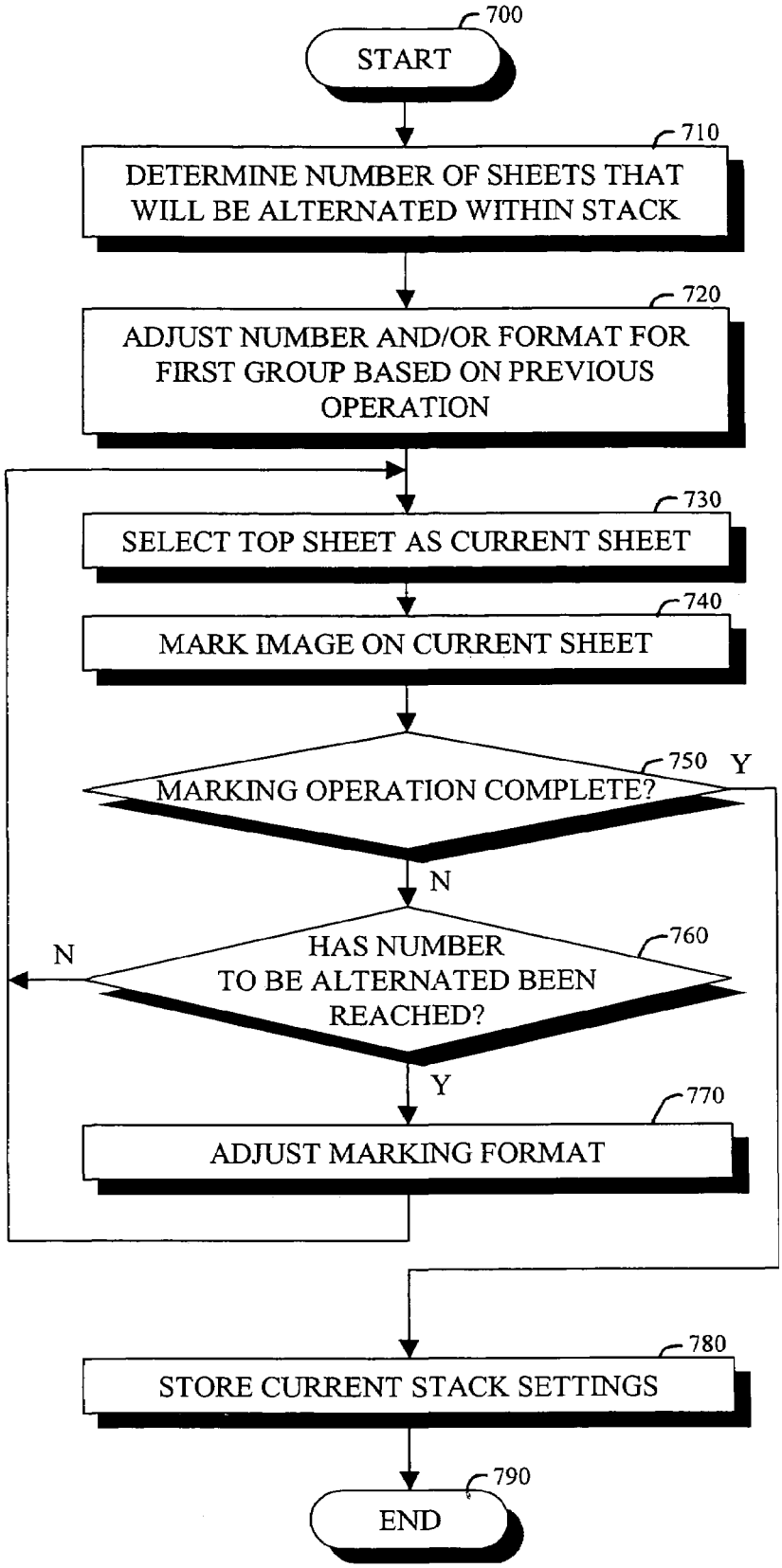
FIG. 10 shows a method of marking multi-thickness media according to an exemplary implementation of the principles described herein.

FIG. 10 shows an exemplary method of marking combined multi-thickness media for use with combined multi-thickness media stacked in an alternating fashion. As shown in FIG. 10, the method begins in step 700 and continues to step 710 where it is determined how many sheets will be alternated within the stack. For example, 5 sheets may be alternated within the stack wherein the first 5 sheets have the small media 120 located in the vicinity of the leading edge of the combined multi-thickness media and the second 5 sheets have the small media 120 located in the vicinity of the trailing edge of the combined multi-thickness media.

The number of sheets that will be alternated may be determined in any number of ways. For example, media may be packaged at the manufacturer with a predetermined number of alternating sheets. Accordingly, the number might be associated with the type of media. The number of sheets that will be alternated may be defined by a user loading the media into a marking device. Accordingly, the user may load the media according to a predetermined number known by the device or the user may input the number of sheets that will be alternated into the device. The number of sheets that will be alternated may be encoded on the media, either visually or otherwise, since the large media 110 will not be marked on it may include a visual indication of the number of sheets that will be alternated. A visual indicator may be read by the user and then input into the device. A visual or non-visual indicator may be detected by a detector within the marking device.

For example, alternation of the combined multi-thickness media in the feeder, and its subsequent presentation to the imaging process requires that the image be modified in order to be placed properly on the media, regardless of the orientation of the media when it is fed into the imaging process, i.e., whether the small media 120 is at the lead edge of the large media 110, or at the trail edge of the large media 110.

In order for the image to be properly oriented on the small media 120, the orientation of the media must be known by the marking device, and may be accomplished through the automatic sensing of the position of the small media 120 on the large media 110 as each sheet is transported past a sensor along or otherwise in communication with the media transport path. The sensor may determine the position of the small media 120 on the large media using of various known or later developed technologies including, for example, transmissive sensing, reflective sensing, and/or thickness sensing. However, it should be appreciated that any senor or sensing technique that is capable of determining the orientation of a sheet of multi-thickness media may be used.

Operation continues to step 720. In step 720, the number of sheets prior to the first orientation change requiring output adjustment (e.g., the position and/or orientation of the marked image) is adjusted based on previous operation. For example, the stack of combined multi-thickness media was loaded into a marking device prior to a previous marking operation. A number of sheets have been transported off of the stack and through the marking device during the previous marking operation. Thus, the number of sheets on the top of the stack before the orientation of the sheets is changed may be less than the total number of sheets that are alternated within the stack. Additionally, the orientation of the top sheet may be different from the orientation of the top sheet when the stack was originally loaded.

For example, assume that a stack of combined multi-thickness media contains sheets that alternate their orientation every five sheets. Assume that a previous marking operation transported six of the sheets off the top of the stack, the first five with a first orientation and the next one with a second orientation. The stack has 4 sheets with the second orientation on top. As a result, the number and/or format of the new first group, i.e., the four sheets on top with the second orientation must be accounted for before the number of alternated sheets returns to the original value (after the top four sheets have been transported of the stack).

There are a number of ways to account for the number and/or format of the first group of sheets. For example, following a marking operation a marking device may store the current stack settings (e.g., step 750). Thus, according to the above example, after the previous marking operation transported six of the sheets of the top of the stack, at least that number would be stored for reference by the marking device. During a subsequent marking operation, the device could refer to the number of sheets previously used, or other data indicating the current state of the stack of combined multi-thickness media, and adjust the number and/or output format for the first group accordingly. According to above example, the stored data would be used to indicate that the first group of the stack contains four sheets with the second orientation, and the marking device could adjust the marking format for the current marking operation accordingly.

Alternatively, the number and/or format of the first group may be visually, or otherwise marked on each sheet of the combined multi-thickness media. Thus, according to the above example, the top sheet would have a visual or non-visual marking detectable by the marking device that indicates the state of the stack. For example, the marking may indicate that the top sheet is the seventh sheet of the stack, with a second orientation, that alternates every five sheets. Based on detecting the mark, the marking device could adjust the marking format for the current marking operation accordingly.

Operation continues to step 730. In step 730, the top sheet of the stack is selected as the current sheet. Then, in step 740, the current sheet is transported through the marking device and marked. In step 750, it is determined whether the marking operation is complete, i.e., have the number of sheets required for the current marking operation been selected and marked. If the marking operation is complete, operation jumps to step 780. If the marking operation is not complete, operation continues to step 760.

In step 760, it is determined whether the number to be alternated has been reached. For example, if groups of five sheets alternate orientation within the stack, and five sheets have been marked, the marking format is adjusted to account for the changed orientation of the sixth sheet. Of course, if a previous marking operation has been marked using the current stack, the number of sheets that has been reached for the first group of sheets in step 760 will have been adjusted in step 720.

If the number of sheets to be alternated has not been reached, operation returns to step 730. If the number of sheets to be alternated has been reached, operation continues to step 770. In step 770, the marking format is adjusted in accordance with the changed orientation of the next sheet to be marked on. Steps 730-770 will continue to be looped until in step 750, the marking operation is complete.

In step 780, the current stack settings are stored so that the number and/or format of the first group may be adjusted in a subsequent marking operation. Of course, step 780 may not be necessary when, as discussed above, the number and/or format of the first group is visually, or otherwise, marked on each sheet of the combined multi-thickness media. Operation continues to step 790 where operation ends.

It should be appreciated that any number of sheets of combined multi-thickness media may make up the groups of sheets whose orientation are alternated within the stack. For example, as much as substantially half of the entire stack may be alternated. Additionally, each single sheet may be alternated. If a small number of sheets are alternated the stack will remain more uniform in thickness as marking operations reduce the number of sheets in the stack. If a larger number of sheets are alternated, the position and/or orientation of the marked image relative to the sheet of combined multi-thickness media will be changed less frequently.

Figure 11:
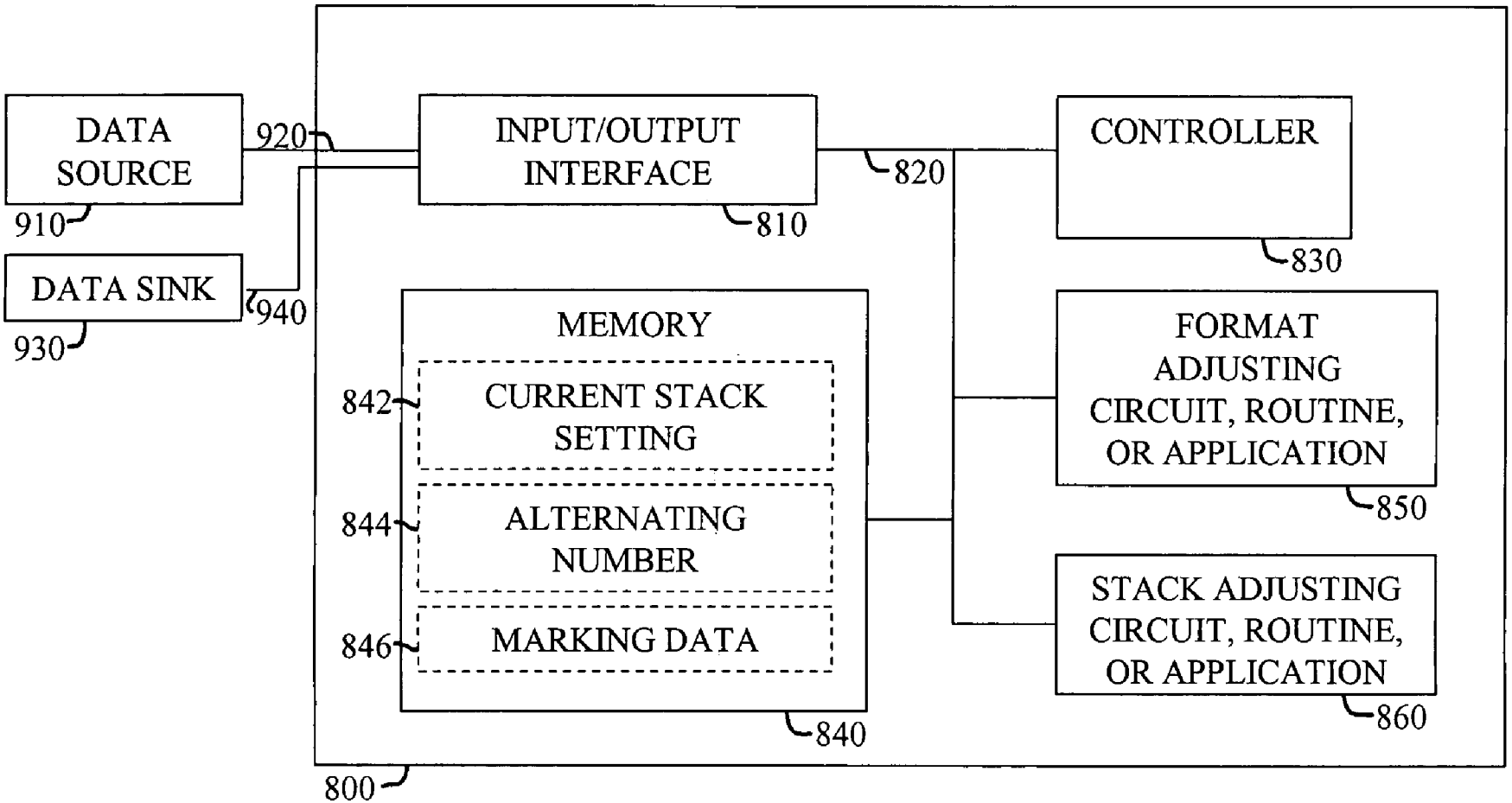
FIG. 11 shows a system for processing multi-thickness media during marking according to an exemplary implementation of the principles described herein.

FIG. 11 shows a functional block diagram of an exemplary system 800 for processing multi-thickness media during marking. As shown in FIG. 11, the system 800 may be physically, functionally, and/or conceptually divided into an input/output interface 810, a controller 830, a memory 840, a format adjusting circuit, routine, or application 850, and/or a stack adjusting circuit, routine, or application 860, each appropriately interconnected by one or more data/control busses and/or application programming interfaces 820, or the like.

The input/output interface 810 may be connected to one or more data sources 910 over one or more links 920. The data source(s) 910 can be a locally or remotely located computer, a printer, a scanner, a facsimile device, a xerographic device, a multi-fictional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data source 910 can be any known or later-developed source that is capable of providing image data to the input/output interface 810.

The input/output interface 810 may be connected to one or more data sinks 930 over one or more links 940. The data sink(s) 930 can be a locally or remotely located inkjet printer, locally or remotely located laser printer, a facsimile device, a xerographic device, a multi-fictional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data sink 930 can be any known or later-developed sink that is capable of storing image data to be marked or capable of marking images based on data output by the input/output interface 810.

Each of the various links 920 and 940 may be any known or later-developed device or system for connecting the data source(s) 910 and/or the data sink(s) 930, respectively, to the input/output interface 810. In particular, the links 920 and 940 my each be implemented as one or more of, for example, a direct cable connection, a connection over a wide area network, a local area network or a storage area network, a connection over an intranet, a connection over an extranet, a connection over the Internet, a connection over any other distributed processing network or system, and/or an infrared, radio-frequency or other wireless connection.

As shown in FIG. 11, the memory 840 may be physically, functionally, and/or conceptually divided into a number of different memory portions, including a current stack setting portion 852, an alternating number portion 854, and/or a marking data portion 856. The current stack setting portion 852 may store the current sate of the stack of combined multi-thickness media such as, for example, how many sheets are in the first group of media and their orientation. The alternating number portion 854 may store the number of sheets that are alternated in the stack of combined multi-thickness media. The marking data portion 846 may store input and/or adjusted marking data.

The memory 840 may be implemented using any appropriate combination of alterable or non-alterable memory, volatile or non-volatile memory, or fixed memory. The alterable memory, whether volatile or non-volatile, can be implemented using any one or more of static or dynamic RAM, a floppy disk and disk drive, a writeable or re-re-writeable optical disk and disk drive, a hard drive, flash memory or the like. Similarly, the non-alterable or fixed memory can be implemented using any one or more of ROM, PROM, EPROM, EEPROM, an optical ROM disk, such as CD-ROM or DVD-ROM disk, and disk drive or the like.

The format adjusting circuit, routine, or application 850 may input data indicating, for example, the current condition of the stack of media and adjust the output format accordingly. The stack adjusting circuit, routine, or application 860 may input, for example, data indicating a current stack setting, data indicating the number of sheets that are alternated, and data indicating the number of sheets of media to be used by a marking operation and adjust the current stack setting accordingly.

For example, in operation, data related to a marking operation may be input from the data source to the input/output interface 810. Under control of the controller 830, the data may be stored in the marking data portion 846 of the memory 840. Alternatively, the marking operation data may be input, under control of the controller 830, directly to the format adjusting circuit, routine, or application 850. Under control of the controller 830, the format adjusting circuit, routine, or application 850 may access the marking operation data, the current stack setting, and the alternating number, and adjust the output data in accordance with the current stack setting and alternating number, for example, according to the above described exemplary method. Under control of the controller 830, the adjusted marking operation data may be stored in the marking data portion 846. Alternatively, the adjusted marking data, under control of the controller 830, may be output directly to the data sink 930 via the input/output interface 810.

During operation, under control of the controller 830, the stack adjusting circuit, routine, or application 860 may access the marking operation data, the current stack setting data, and the alternating number, and determine how many sheets of the combined multi-thickness media within the stack will be or have been utilized for the marking operation, and adjust the current stack setting accordingly. Then, under control of the controller 830, the adjusted stack setting data may be stored in the current stack setting portion for a subsequent marking operation.

Each time a new stack of media is loaded into a marking device for which the exemplary system 800 is adjusting the marking operation data, the current stack setting and/or alternating number may be reset.

Alternatively, the current stack setting may be included as part of the marking data, for each marking operation, for example, when a current setting of the stack may be determined from a mark on each sheet of the combined multi-thickness media in the stack. In such a case, the stack adjusting circuit, routine, or application may be omitted from the exemplary system 800.

It should be appreciated that, although the above-described system 800 may input marking data for an entire marking operation. The system 800 may input marking data for each sheet of media individually, adjust the format of the marking data for that sheet, if necessary, and adjust the current stack setting after that adjusted marking data for that sheet has been output.

While the exemplary system 800 has been described as physically, functionally, and/or conceptually divided into a format adjusting circuit, routine, or application 850, and/or a stack adjusting circuit, routine, or application 860, it should be appreciated that one or more of the circuits, routines, or applications may be included in and/or executed by the controller 830.

Figure 12:
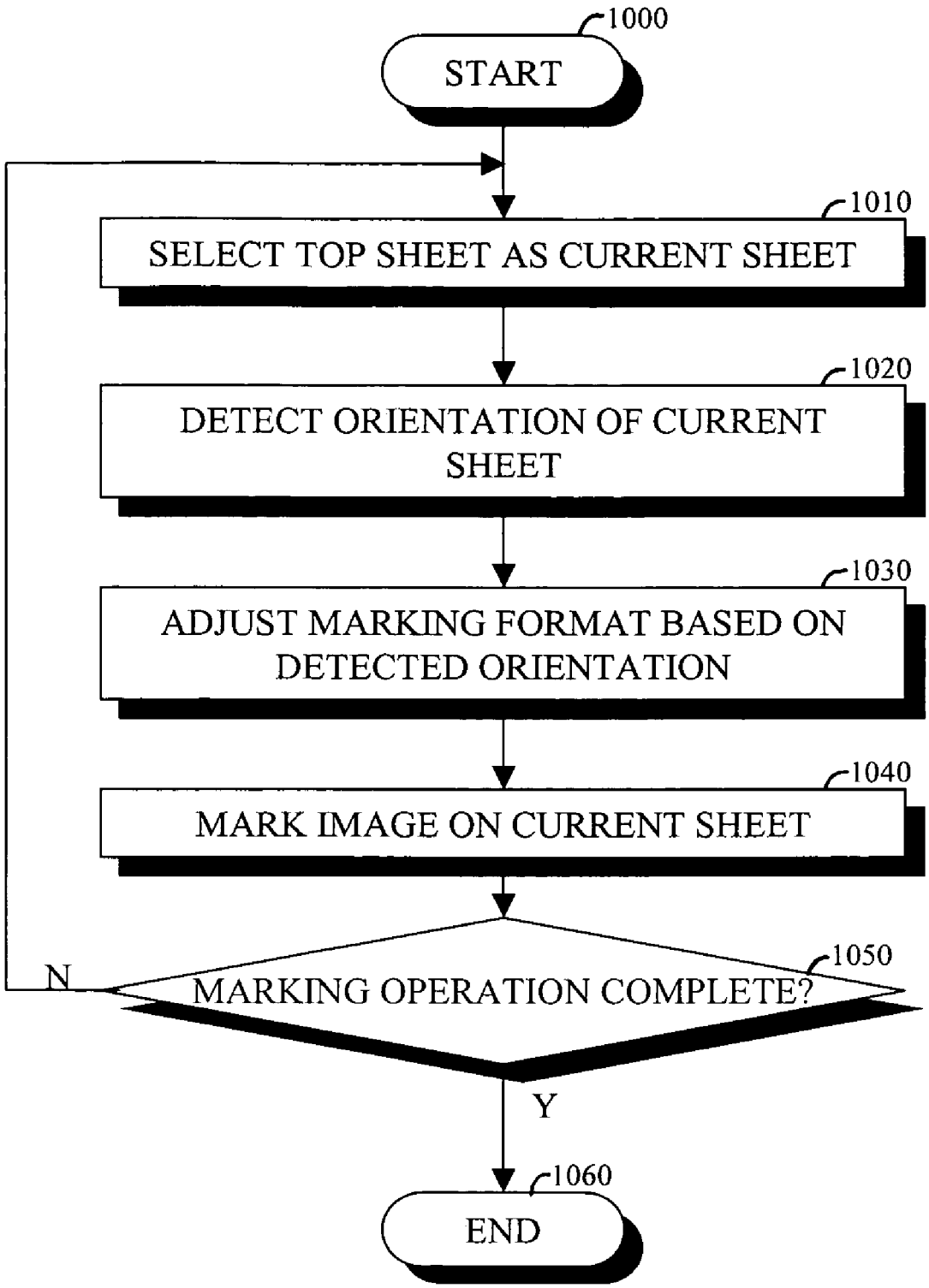
FIG. 12 shows a method of marking multi-thickness media according to an exemplary implementation of the principles described herein.

FIG. 12 shows an exemplary method of marking combined multi-thickness media for use with combined multi-thickness media stacked in an alternating fashion. As shown in FIG. 12, the method begins in step 1000 and continues to step 1010 where the top sheet of the stack is selected as a current sheet. Then, in step 1020 the orientation of the current sheet is detected.

For example, alternation of the combined multi-thickness media in the feeder, and its subsequent presentation to the imaging process requires that the image be modified in order to be placed properly on the media, regardless of the orientation of the media when it is fed into the imaging process, i.e., whether the small media 120 is at the lead edge of the large media 110, or at the trail edge of the large media 110.

In order for the image to be properly oriented on the small media 120, the orientation of the media must be known by the marking device, and may be accomplished through the automatic sensing of the position of the small media 120 on the large media as each sheet is transported past a sensor along or otherwise in communication with the media transport path. The sensor may determine the position of the small media 120 on the large media 110 using of various known or later developed technologies including, for example, transmissive sensing, reflective sensing, and/or thickness sensing. However, it should be appreciated that any senor or sensing technique that is capable of determining the orientation of a sheet of multi-thickness media may be used.

In transmissive sensing, for example, the media may be transported between a signal transmitter and signal receiver. A signal is sent by the transmitter, thought the sheet, to the receiver. The receiver can discriminate between the large media 110 portion of a sheet and the small media 120 portion of a sheet as each sheet passes between the transmitter and receiver based on the transmissibility of the signal energy passed through the media. The signal energy may include, for example, visible light, an infrared signal, an ultrasonic signal, and/or signals based on other energy spectra.

In reflective sensing, for example, the media may be transported over and/or under a signal transmitter that would reflect signal energy off the surface of the media, back to a signal receiver. The receiver would be able to discriminate between the large media 110 and small media 120 as each passed over and/or under the transmitter and receiver based on the strength of the signal reflected off of the media. For example, thinner and/or less dense media may allow more of the signal to pass through the media resulting in a weaker reflected signal. Thicker and/or denser media would allow less of the signal to pass through the media, resulting in a stronger reflected signal. The signal energy may include, for example, visible light, an infrared signal, an ultrasonic signal, and/or signals based on other energy spectra.

In thickness sensing, for example, the media may be transported over and/or under a thickness sensor that could discriminate between the thickness of the large media 110 and the thickness of the small media 120 by using, for example a pair of rollers that contact both the top and bottom of the media and exert compressive force on the media. As the larger, thinner, media portion passes through the rollers, the rollers would compress towards one another. As the smaller, thicker, media portion passes through the rollers, the thickness of the media would force the rollers apart. By sensing the distance between the rollers, the marking device could determine the thickness of the media.

Operation continues to step 1030. In step 1030, based on detecting of the orientation, the marking device may adjust the marking format for marking on the current sheet. As discussed above, the imaging process requires that the image is properly oriented on the small media 120. Thus, after the orientation of the sheet is detected, the marking format may be adjusted to correspond with the detected orientation.

Operation continues to step 1040. In step 1040, the current sheet is transported through the marking device and marked. In step 1050, it is determined whether the marking operation is complete, i.e., have the number of sheets required for the current marking operation been selected and marked. If the marking operation is complete, operation jumps to step 1060. If the marking operation is not complete, operation returns to step 1010. In step 1060, operation of the exemplary method ends.

It should be appreciated that any number of sheets of combined multi-thickness media may make up the groups of sheets whose orientation are alternated within the stack. For example, as much as substantially half of the entire stack may be alternated. Additionally, each single sheet may be alternated. If a small number of sheets are alternated the stack will remain more uniform in thickness as marking operations reduce the number of sheets in the stack. If a larger number of sheets are alternated, the position and/or orientation of the marked image relative to the sheet of combined multi-thickness media will be changed less frequently.

Figure 13:
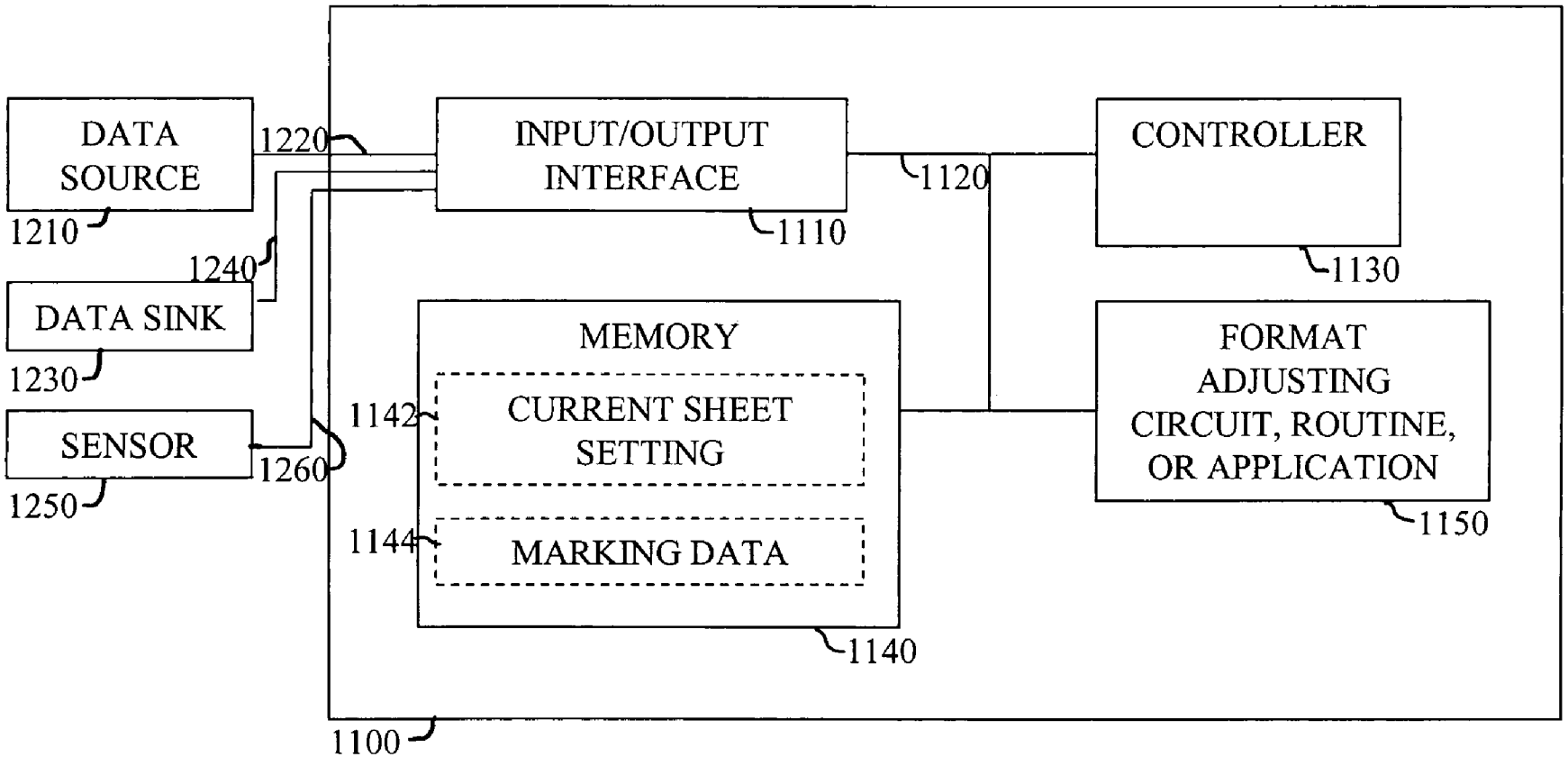
FIG. 13 shows a system for processing multi-thickness media during marking according to an exemplary implementation of the principles described herein.

FIG. 13 shows a functional block diagram of an exemplary system 800 for processing multi-thickness media during marking using a sensor. As shown in FIG. 13, the system 1100 may be physically, functionally, and/or conceptually divided into an input/output interface 1110, a controller 1130, a memory 1140, and/or a format adjusting circuit, routine, or application 1150, each appropriately interconnected by one or more data/control busses and/or application programming interfaces 1120, or the like.

The input/output interface 1110 may be connected to one or more data sources 1210 over one or more links 1220. The data source(s) 1210 can be a locally or remotely located computer, a printer, a scanner, a facsimile device, a xerographic device, a multi-fictional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data source 1210 can be any known or later-developed source that is capable of providing image data to the input/output interface 1110.

The input/output interface 1110 may be connected to one or more data sinks 1230 over one or more links 1240. The data sink(s) 1230 can be a locally or remotely located inkjet printer, locally or remotely located laser printer, a facsimile device, a xerographic device, a multi-fictional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data sink 1230 can be any known or later-developed sink that is capable of storing image data to be marked or capable of marking images based on data output by the input/output interface 1110.

The input/output interface 1110 may be connected to one or more sensors 1250 over one or more links 1260. The sensor(s) 1250 may include one or more of, for example, a transmissive sensor, a reflective sensor, and/or a thickness sensor. In general, the sensor 1250 can be any known or later-developed sensing device that is capable of sensing of the position of the small media on the large media as each sheet is transported past the sensor 1250.

Each of the various links 1220, 1240 and 1260 may be any known or later-developed device or system for connecting the data source(s) 1210, the data sink(s) 1230, and/or the sensor (s) 1250, respectively, to the input/output interface 1110. In particular, the links 1220, 1240 and 1260 my each be implemented as one or more of, for example, a direct cable connection, a connection over a wide area network, a local area network or a storage area network, a connection over an intranet, a connection over an extranet, a connection over the Internet, a connection over any other distributed processing network or system, and/or an infrared, radio-frequency or other wireless connection.

As shown in FIG. 13, the memory 1140 may be physically, functionally, and/or conceptually divided into a number of different memory portions, including, for example, a current sheet setting portion 1142 and/or a marking data portion 1144. The current sheet setting portion 1142 may store the orientation of the current sheet of combined multi-thickness media to be marked. The marking data portion 1146 may store input and/or adjusted marking data, for example, for the current sheet and/or the current marking operation including a marking data for a plurality of sheets.

The memory 1140 may be implemented using any appropriate combination of alterable or non-alterable memory, volatile or non-volatile memory, or fixed memory. The alterable memory, whether volatile or non-volatile, can be implemented using any one or more of static or dynamic RAM, a floppy disk and disk drive, a writeable or re-re-writeable optical disk and disk drive, a hard drive, flash memory or the like. Similarly, the non-alterable or fixed memory can be implemented using any one or more of ROM, PROM, EPROM, EEPROM, an optical ROM disk, such as CD-ROM or DVD-ROM disk, and disk drive or the like.

The format adjusting circuit, routine, or application 1150 may input data indicating, for example, an orientation of the current sheet and adjust the output format accordingly.

For example, in operation, data related to a marking operation may be input from the data source 1210 to the input/output interface 1110. Under control of the controller 1130, the data may be stored in the marking data portion 1144 of the memory 1140. Alternatively, the marking operation data may be input, under control of the controller 1130, directly to the format adjusting circuit, routine, or application 1150.

Next, for example, current sheet setting data representing the orientation of a sheet to be marked on may be input from the sensor 1250 to the input/output interface 1110. Under control of the controller 1130, the data may be stored in the current sheet setting portion 1142 of the memory 1140. Alternatively, the current sheet setting data may be input, under control of the controller 1130, directly to the format adjusting circuit, routine, or application 1150.

Under control of the controller 1130, the format adjusting circuit, routine, or application 1150 may access the marking operation data and the current sheet setting data and adjust the marking operation data in accordance with the current sheet setting, for example, according to the above described exemplary method. Under control of the controller 1130, the adjusted marking operation data may be stored in the marking data portion 1144. Alternatively, the adjusted marking data, under control of the controller 1130, may be output directly to the data sink 1230 via the input/output interface 1110.

It should be appreciated that, although the above-described system 800 may input marking data for an entire marking operation. The system 1100 may input marking data for each sheet of media individually.

While the exemplary system 1100 has been described as physically, functionally, and/or conceptually divided into at least a controller 1130 and/or a format adjusting circuit, routine, or application 1150, it should be appreciated that one or more of the circuits, routines, or applications may be included in and/or executed by the controller 1140. Furthermore, while the exemplary system 1100 has been described as connected to, but not including, the data source 1210, the data sink 1230, and the sensor 1250, one or more of the data source 1210, the data sink 1230, and the sensor 1250 may be included in the system 1100.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

For example, while the exemplary methods and systems described herein are described within the context of combined multi-thickness media, the methods and systems are applicable to any media that has a thickness variation between its leading edge portion and its trailing edge portion.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of adjusting marking data for use with alternately stacked groups of multi-thickness media of a same orientation, each sheet of media having multiple thicknesses, comprising:

inputting marking data;

detecting an orientation of each sheet of multi-thickness media that is alternated within a stack with respect to the multiple thicknesses; and adjusting, for each sheet of multi-thickness media whose orientation is not consistent with the marking data, the marking data for that sheet of multi-thickness media such that the marking data for that sheet of multi-thickness media is consistent with the orientation of that sheet of multi-thickness media.

2. The method of claim 1, wherein detecting an orientation of each sheet of multi-thickness media that is alternated within a stack comprises:

sensing, with a sensor, an orientation of each sheet of multi-thickness media that is alternated within a stack.

3. The method of claim 2, wherein the sensor comprises at least one of:

a transmissive sensor;

a reflecting sensor; and a thickness sensor.

4. The method of claim 2, wherein:

sensing, with the sensor, the orientation of each sheet of multi-thickness media that is alternated within the stack comprises individually sensing the orientation of each sheet of multi-thickness media; and adjusting, for each sheet of multi-thickness media whose sensed orientation is not consistent with the marking data, the marking data for that sheet of multi-thickness media such that the marking data for that sheet of multi-thickness media is consistent with the sensed orientation of that sheet of multi-thickness media comprises adjusting the orientation for each sheet of multi thickness media before sensing a next ordination of a next sheet of multi-thickness media.

5. The method of claim 1, further comprising:

adjusting a predetermined number of sheets of the multi-thickness media within a group of sheets of the multi-thickness media on top of the stack and having a same orientation.

6. The method of claim 1, further comprising:

adjusting a predetermined orientation of sheets of the multi-thickness media within a group of sheets of the multi-thickness media on top of the stack and having a same orientation.

7. The method of claim 1, further comprising:

storing a current setting of the stack following a marking operation.

8. The method of claim 1, further comprising:

determining a current setting of the stack prior to a marking operation.

9. The method of claim 1, wherein the multi-thickness media is combined multi-thickness media, comprising at least a first sheet of media fixed to a second larger sheet of media, the combined multi-thickness media being thicker in a vicinity of the first sheet of media than in a vicinity of only the second sheet of media.

10. A storage medium storing a set of program instructions executable on a data processing device and usable to adjust marking data for use with alternately stacked groups of multi-thickness media of a same orientation, each sheet of media having multiple thicknesses, the instructions comprising:

instructions for inputting marking data;

instructions for detecting an orientation of each sheet of multi-thickness media that are alternated within a stack with respect to the multiple thicknesses; and instructions for adjusting, for each sheet of multi-thickness media whose orientation is not consistent with the marking instructions, the marking data for that sheet of multi-thickness media such that the marking data for that sheet of multi-thickness media is consistent with the orientation of that sheet of multi-thickness media.

11. A system for adjusting marking data for use with alternately stacked groups of multi-thickness media of a same orientation, each sheet of media having multiple thicknesses, comprising:

a controller that:

inputs marking data;

detects an orientation of each sheet of multi-thickness media that is alternated within a stack with respect to the multiple thicknesses; and adjusts, for each sheet of multi-thickness media whose determined orientation is not consistent with the marking data, the marking data for that sheet of multi-thickness media such that the marking data for that sheet of multi-thickness media is consistent with the determined orientation of that sheet of multi-thickness media.

12. The system of claim 11, wherein the controller:

detects, for each sheet of multi-thickness media, the orientation of that sheet before the sheet is marked.

13. The system of claim 11, further comprising a sensor that detects the orientation of each sheet of multi-thickness media.

14. The system of claim 13, wherein the sensor comprises at least one of:

a transmissive sensor;

a reflecting sensor; and a thickness sensor.

15. The system of claim 11, wherein the multi-thickness media is combined multi-thickness media, comprising at least a first sheet of media fixed to a second larger sheet of media, the combined multi-thickness media being thicker in a vicinity of the first sheet of media than in a vicinity of only the second sheet of media.

16. A xerographic device comprising the system of claim 11.

17. An inkjet printer comprising the system of claim 11.

18. A laser printer comprising the system of claim 11.

* * * * *